US005875849A

United States Patent [19]

Martin et al.

[11] Patent Number: 5,875,849

[45] Date of Patent: Mar. 2, 1999

[54] APPARATUS AND METHOD FOR RECOMPLETING WELLS WITH COILED TUBING

[75] Inventors: Kevin Martin; Stephen Mescall, both of Aberdeen, Scotland

[73] Assignee: Camco Drilling Group Limited, Stonehouse, England

[21] Appl. No.: 889,289

[22] Filed: Jul. 8, 1997

[30] Foreign Application Priority Data

Jul. 26, 1996 [GB] United Kingdom ..... 9615742

[51] Int. Cl.[6] ..... E21B 23/02

[52] U.S. Cl. ..... 166/382; 166/72; 166/242.2

[58] Field of Search ..... 166/242.2, 72, 166/212, 372, 87.1, 382, 50

[56] References Cited

U.S. PATENT DOCUMENTS

| | | | |
|---|---|---|---|
| 3,625,281 | 12/1971 | Herd | 166/212 X |
| 3,807,497 | 4/1974 | Baugh | 166/87.1 |
| 4,189,003 | 2/1980 | James et al. | 166/364 X |
| 4,844,166 | 7/1989 | Going, III et al. . | |
| 5,411,085 | 5/1995 | Moore et al. | 166/242.2 |

FOREIGN PATENT DOCUMENTS

| | | |
|---|---|---|
| 2219611 | 12/1989 | United Kingdom . |
| 2283517 | 5/1995 | United Kingdom . |

*Primary Examiner*—Frank S. Tsay

[57] ABSTRACT

Apparatus for recompleting an oil and/or gas well includes a primary tubing hanger, and primary well tubing hung from the hanger within the well, and a communication/hanger nipple, located below the primary tubing hanger, which is suitable for receiving and locating a coiled tubing hanger. The communication/hanger nipple is run into the well as part of the initial completion in any situation where there is a potential requirement for a coiled tubing completion later in the life of the well but plays no part in the normal primary production operation of the well. However, should production fail for any reason, requiring coiled tubing recompletion, the communication/hanger nipple is available to support the coiled tubing and provide communication to the subsurface equipment without the necessity of modifying the primary tubing hanger.

9 Claims, 2 Drawing Sheets

APPARATUS AND METHOD FOR RECOMPLETING WELLS WITH COILED TUBING

BACKGROUND OF THE INVENTION

1. Field of the Invention

The present invention relates to an apparatus and method for recompleting a well and, more particularly, to recompleting a well using coiled tubing.

2. Description of Related Art

Once an oil or gas well has been drilled, the oil or gas is generally produced from the well by introducing into the borehole well tubing which is of smaller diameter than the borehole, together with associated production equipment to deliver the oil or gas upwardly through the well tubing to the surface. The well tubing normally comprises interconnected rigid threaded sections of pipe hung from a tubing hanger positioned at the upper end of the borehole.

In the course of production, however, it may happen that it becomes no longer possible to continue production from the well with the existing apparatus. This may be due, for example, to failure in some part of the production equipment or it may happen that the downhole pressure may fall to an extent whereby it becomes impossible to deliver the oil or gas upwardly through the existing well tubing.

In the past such failure of production made it necessary to kill the well and to remove, and repair or replace, the entire production installation, which was a lengthy and costly operation and which could also result in damage to the well. It has therefore been proposed, for example as described in U.S. Pat. No. 4,844,166, to recomplete a failed well by passing coiled tubing down through the primary well tubing, together with the equipment and accessories necessary for allowing oil or gas to continue to be delivered to the surface through the coiled tubing.

Coiled tubing is a continuous flexible pipe wound on a reel and which can be unreeled as it is passed down the borehole. The tubing is normally of small diameter compared to normal production well tubing, and may have a diameter of only 1–1½ inches. The advantage of using coiled tubing for well recompletion is that it does not require the well to be killed and also avoids the costly removal and replacement of the primary well tubing and associated production equipment.

However, as previously mentioned, the primary production tubing for a well is normally supported at the upper end of the well by a tubing hanger, and where coiled tubing is subsequently employed for recompletion the coiled tubing also requires to be supported in similar fashion. In addition, the arrangement for supporting the coiled tubing may require to permit communication to subsurface equipment, such as a subsurface safety valve. At present coiled tubing completions which require communication to subsurface equipment must be hung off in a modified tubing hanger. However, modifying the existing tubing hanger to support the coiled tubing in a manner to provide communication to subsurface equipment is currently an expensive operation, and there is therefore a requirement for a simpler and less expensive system for supporting the coiled tubing completion assembly.

SUMMARY OF THE INVENTION

It is an object of the invention to provide an improved apparatus and method which allows coiled tubing recompletion of an oil or gas well without requiring the costly modification of the existing tubing hanger. According to the invention there is provided an apparatus for recompleting an oil and/or gas well including a primary tubing hanger, and primary well tubing hung from said hanger within the well, said apparatus also including a communication/hanger nipple located below the primary tubing hanger, which nipple is suitable for receiving and locating a coiled tubing hanger from which is hung coiled tubing inside the primary well tubing, to enable a subsequent recompletion of the well using such coiled tubing.

Thus, the communication/hanger nipple is run into the well as part of the initial completion in any situation where there is a potential requirement for a coiled tubing completion later in the life of the well. The nipple is simply run in with the primary well tubing and plays no part in the normal primary production operation of the well. However, should production fail for any reason, requiring coiled tubing recompletion, the communication/hanger nipple is available to support the coiled tubing and provide communication to the subsurface equipment at a fraction of the cost of modifying the primary tubing hanger.

After the coiled tubing completion assembly has been lowered down the depth of the well and spaced out, i.e. the coiled tubing cut to the appropriate length, the upper end of the coiled tubing is connected to a suitable coiled tubing hanger which is then landed in the pre-installed communication/hanger nipple, to support the coiled tubing installation in the well.

Preferably the communication/hanger nipple includes a hydraulic control passage for connection to a hydraulic control line from the well head, which passage communicates with a hydraulic control line extending downhole. For example, the control line may extend outside the coiled tubing and inside the primary well tubing. Said hydraulic control passage in the nipple may also communicate with a further hydraulic control line extending down the well outside of the primary well tubing. The interior of the communication/hanger nipple may include a locking profile for engagement by locking lugs on the coiled tubing hanger, and a locator profile for engagement by locator keys on the coiled tubing hanger.

Alternatively, the interior of the nipple may include a locking profile for engagement by locking lugs on the coiled tubing hanger, and a no-go shoulder for engagement by a co-operating shoulder on the coiled tubing hanger.

The invention also provides apparatus for recompleting an oil and/or gas well including a primary tubing hanger, primary well tubing hung from said hanger within the well, a communication/hanger nipple located below the primary tubing hanger, and a coiled tubing hanger received and located within the nipple, from which is hung coiled tubing positioned inside the primary well tubing. A subsurface safety valve may be provided on the coiled tubing for closing off the coiled tubing when necessary, the valve being controlled by a hydraulic control line which communicates with said valve through passages in the nipple.

The invention further provides a method for recompleting an oil and/or gas well having primary completion apparatus including a primary tubing hanger and primary well tubing hung from said hanger within the well, the method including the step of initially including in the primary completion apparatus a communication/hanger nipple located below the primary tubing hanger and then subsequently, when the primary completion apparatus becomes non-functional, locating in the nipple a coiled tubing hanger from which is hung coiled tubing recompletion apparatus inside the primary well tubing.

DETAILED DESCRIPTION OF THE PREFERRED EMBODIMENTS

Figure 1:
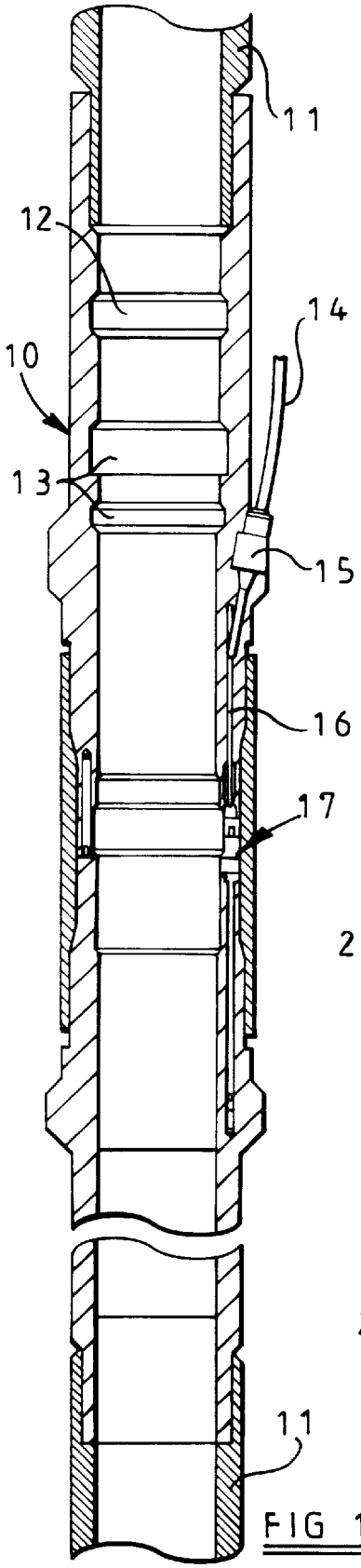
FIG. 1 is a longitudinal section through a communication/hanger nipple for use in the present invention.

Referring to FIG. 1, according to the present invention a communication/hanger nipple 10 is inserted in the primary well production tubing 11 at the upper end of the well. The nipple 10 is run in with the production tubing 11 during the normal primary completion of the well. The nipple plays no part in the normal production from the well through the well tubing 11, and is only brought into operation should such production fail for any reason.

The nipple 10 comprises an internal annular locking profile 12 spaced below which is an internal annular locator profile 13. A hydraulic control line 14 is coupled to a connector 15 on the nipple and communicates in known manner with passages 16 which may be arranged to communicate with the interior of the nipple through a known form of mechanism, indicated generally at 17, which may actuated from the surface, for example by a wire line.

Figure 2:
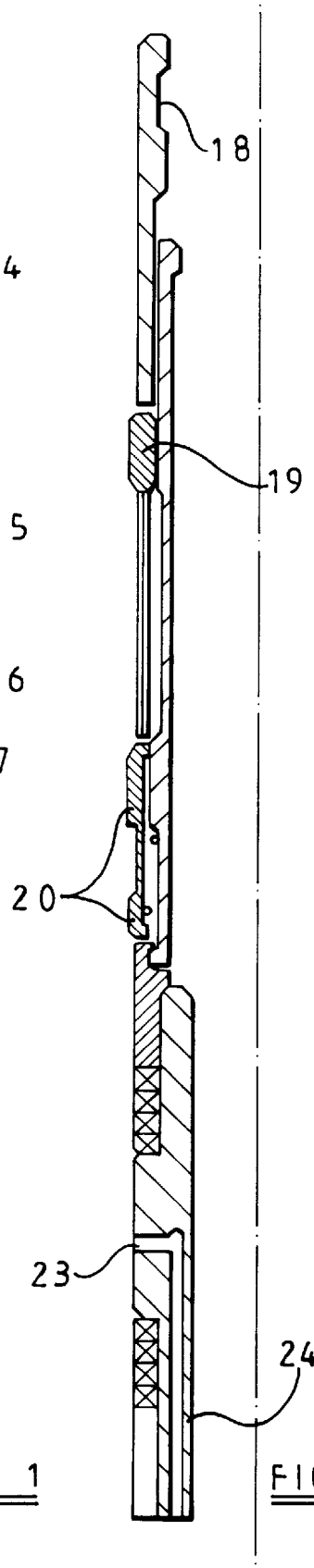
FIG. 2 is a half longitudinal section through a coiled tubing hanger for use with the nipple of FIG. 1.

As previously described, should failure of the primary production apparatus occur, the well may be recompleted by passing downwardly through the primary tubing 11 a coiled tubing completion assembly hung from a hanger which is landed in the nipple 10. FIG. 2 is a diagrammatic half section of a suitable form of coiled tubing hanger for use with the nipple 10 of FIG. 1.

The hanger is generally tubular and includes at its upper end a running/retrieving recess for engagement by a known form of hydraulically operated tool to enable the hanger to be lowered into the nipple 10 or retrieved from the nipple. The hanger also comprises locking lugs 19 and locator keys 20 for engagement with the internal profiles 12 and 13 respectively on the nipple 10. The locator keys 20 are spring-loaded outwardly and are designed to automatically engage with the locator profile 13 as the hanger is lowered into the nipple, so as automatically to locate the hanger in the correct longitudinal position within the nipple. When the hanger is correctly located the locking lugs 19 are urged outwardly into locking engagement with the profile 10, the mechanism for this purpose being operated in known manner from the surface. When the hanger is in position in the nipple, the hydraulic passages 16 within the nipple communicate with an entrance port 23 in the hanger which leads to a passage 24.

The length of coiled tubing, together with any associated accessories, is connected to the lower end of the hanger by means of a suitable coiled tubing adaptor (not shown) and a hydraulic control line extends longitudinally of the coiled tubing and is arranged at its upper end to communicate with the passage 24 in the hanger, and hence with the passages 16 and hydraulic control line 14, when the hanger is correctly located in the nipple. The nipple may also include a flow diverter whereby the control line 14 may also be placed in communication with another hydraulic control line connected to the exterior of the nipple 10.

Figure 3:
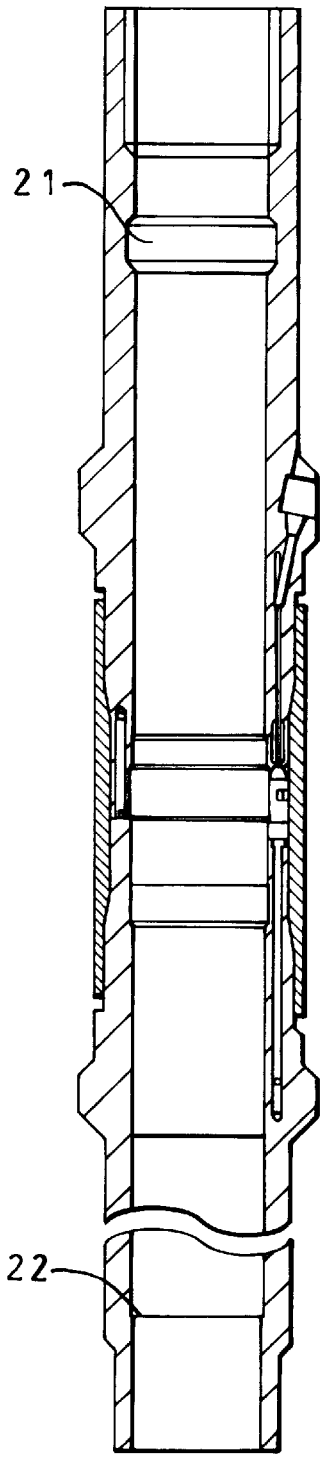
FIG. 3 is a similar view to FIG. 1 of an alternative form of communication/hanger nipple.

FIG. 3 shows an alternative "no-go" type of nipple. The nipple is again provided with an internal locking profile 21 for engagement by the locking lug 19 on the hanger, but in this case the locator keys 20 on the hanger are replaced by a downwardly facing annular surface (not shown) which, as the hanger is lowered into the nipple, engages and is supported by a narrow annular upwardly facing no-go shoulder which can be located anywhere within the nipple. Such arrangements provides 360° support for the hanger within the nipple. In the arrangement shown in FIG. 3 the no-go shoulder 22 is located at the lower end of the nipple.

Figure 4:
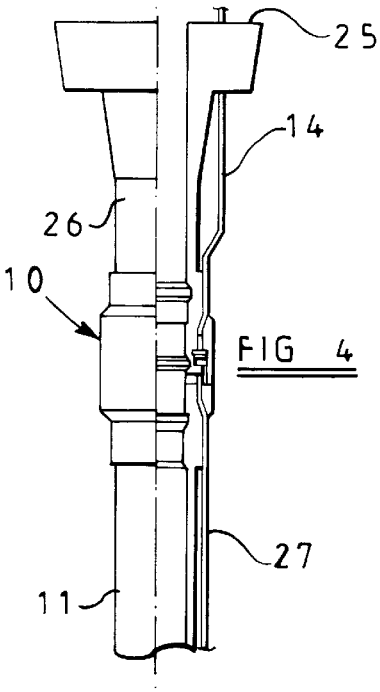
FIGS. 4–8 are half-elevation/half-section views of complete apparatus according to the invention, showing the stages in the sequence of operations.

FIGS. 4–8 show the different stages in operation of well completion apparatus in accordance with the present invention, using a no-go type of nipple. FIG. 4 shows the situation during the initial completion of the well where the communication/hanger nipple 10 is run as part of the tubing 11 during the initial completion, being connected to the production tubing hanger 25 by a pup joint 26. The nipple is closed and hydraulic communication exists between the surface and the tubing retrievable safety valve (TRSV) by the hydraulic control lines 14, 27.

Figure 5:
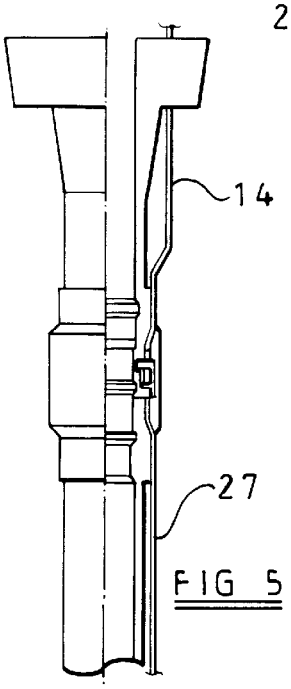

When it is required to re-complete the well using coiled tubing, the nipple 10 is actuated, as shown in FIG. 5, using traditional wireline methods, to allow communication between the control line 14 and the interior of the nipple. The hydraulic control line 27 leading to the TRSV may be isolated, or the nipple may be provided with a diverter valve so that control of the TRSV is available if required.

Figure 6:
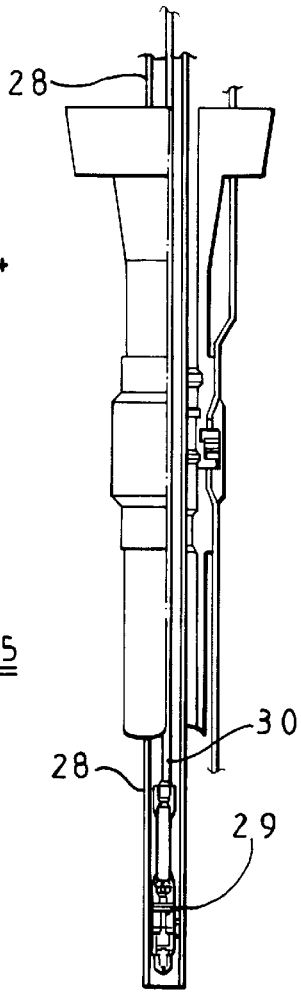
Figure 7:
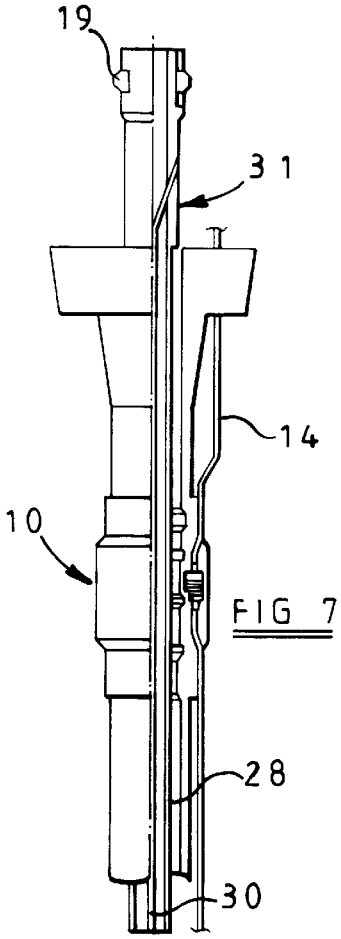
Figure 8:
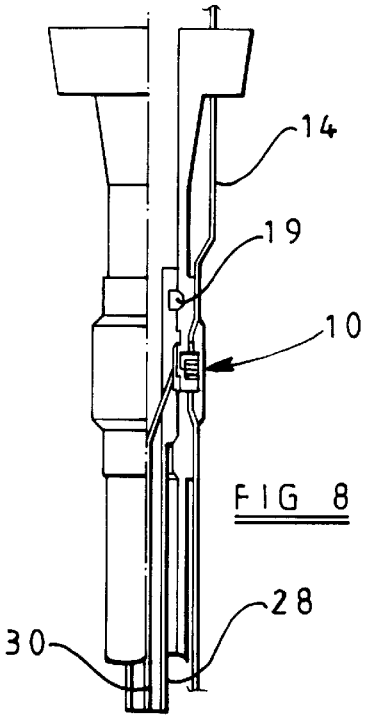

As shown in FIG. 6, the coiled tubing completion is then run to the bottom of the well and spaced out. The coiled tubing completion comprises the coiled tubing 28 itself, a coiled tubing safety valve 29, a control line 30 for the coiled tubing safety valve (CTSV), and any other associated accessories. Referring to FIG. 7, the hanger 31 is then made up and coupled to the upper end of the length of coiled tubing 28. The assembly of hanger and coiled tubing is run in the well until the hanger 31 enters the nipple 10. The hanger is automatically located in the nipple 10 by the no-go shoulder, and the locking lugs 19 are then actuated to secure the hanger to the nipple. Once the hanger 31 is located in the nipple 10 the CTSV control line 30 is in communication, through the nipple, with the control line 14 to provide hydraulic communication to the CTSV and any other subsurface equipment. The engagement of the locking lugs 19 with the locking profile 12 prevents the hanger moving upwardly under the effects of shocks or pressure down the well, as well as supporting the coiled tubing.

Whereas the present invention has been described in particular relation to the drawings attached hereto, it should be understood that other and further modifications, apart from those shown or suggested herein, may be made within the scope and spirit of the present invention.

What is claimed:

1. Apparatus for recompleting a well comprising a primary tubing hanger, and primary well tubing hung from said hanger within the well, a communication/hanger nipple located below the primary tubing hanger, said nipple is suitable for receiving and locating a coiled tubing hanger, from which is hung coiled tubing inside the primary well tubing, to enable a subsequent recompletion of the well using such coiled tubing.

2. Apparatus of claim 1 wherein the communication/hanger nipple includes a hydraulic control passage for connection to a hydraulic control line from the well head, said passage communicates with a hydraulic control line extending downhole.

3. Apparatus of claim 2 wherein the downhole extending hydraulic control line extends outside the coiled tubing and inside the primary well tubing.

4. Apparatus of claim 2 wherein said hydraulic control passage in the nipple also communicates with a further hydraulic control line extending down the well outside of the primary well tubing.

5. Apparatus of claim 1 wherein the interior of the communication/hanger nipple includes a locking profile for engagement by locking lugs on the coiled tubing hanger, and a locator profile for engagement by locator keys on the coiled tubing hanger.

6. Apparatus of claim 1 wherein the interior of the nipple includes a locking profile for engagement by locking lugs on the coiled tubing hanger, and a no-go shoulder for engagement by a co-operating shoulder on the coiled tubing hanger.

7. Apparatus for recompleting a well comprising a primary tubing hanger, primary well tubing hung from said hanger within the well, a communication/hanger nipple located below the primary tubing hanger, and a coiled tubing hanger received and located within the nipple, from which is hung coiled tubing positioned inside the primary well tubing.

8. Apparatus of claim 7 wherein a subsurface safety valve is provided on the coiled tubing for closing off the coiled tubing when necessary, the valve being controlled by a hydraulic control line which communicates with said valve through passages in the nipple.

9. A method for recompleting a well having primary completion apparatus including a primary tubing hanger and primary well tubing hung from said hanger within the well, the method comprising including a communication/hanger nipple located below the primary tubing hanger and then subsequently, when the primary completion apparatus becomes non-functional, locating in the nipple a coiled tubing hanger from which is hung coiled tubing recompletion apparatus inside the primary well tubing.

* * * * *